362-112 SR
9/16/80 OR 4,223,376

United States Patent [19]
Ikeda

[11] 4,223,376
[45] Sep. 16, 1980

[54] APPARATUS FOR PROJECTING A LIGHT BEAM

[75] Inventor: Masaki Ikeda, Tokyo, Japan

[73] Assignee: Tomy Kogyo Co., Inc., Tokyo, Japan

[21] Appl. No.: 8,747

[22] Filed: Feb. 1, 1979

Related U.S. Application Data

[62] Division of Ser. No. 874,858, Feb. 3, 1978.

[51] Int. Cl.[2] ..... F41G 1/34; G05D 25/00

[52] U.S. Cl. ..... 362/112; 273/311; 350/266

[58] Field of Search ..... 350/266; 362/111-114; 273/101.1

[56] References Cited

U.S. PATENT DOCUMENTS

| | | | |
|---|---|---|---|
| 1,376,357 | 4/1921 | Place | 362/111 |
| 1,432,254 | 10/1922 | Paterson et al. | 362/112 |
| 2,119,005 | 5/1938 | Carter | 362/112 |
| 2,236,390 | 3/1941 | Wood et al. | 273/101.1 |
| 3,364,345 | 1/1968 | Davis | 362/111 |

*Primary Examiner*—F. L. Evans
*Attorney, Agent, or Firm*—Edward D. O'Brian

[57] ABSTRACT

An apparatus for projecting a light beam is disclosed which is constructed so as to simulate a gun. Within the apparatus a light bulb is mounted upon a base having a spherical surface. This base is resiliently engaged by a bearing having a correspondingly shaped interior in such a manner that the position of the bulb may be adjusted slightly so that the filament of the bulb is correctly positioned relative to a lens used in projecting a light beam. In the apparatus the bulb and the lens are separated by a shutter mechanism. The apparatus includes a trigger which, when actuated, first closes a switch to supply electric power to the light bulb and then causes the release of a shutter actuator serving to move the shutter so that it opens and closes within a comparatively short time interval.

4 Claims, 6 Drawing Figures

APPARATUS FOR PROJECTING A LIGHT BEAM

CROSS REFERENCE TO RELATED APPLICATIONS

This application is a division of application Ser. No. 874,858, filed Feb. 3, 1978.

BACKGROUND OF THE INVENTION

The invention set forth in this specification pertains to a new and improved apparatus for use in projecting a light beam. In accordance with this invention such an apparatus is constructed so as to simulate a gun and is intended to be utilized in actuating a photocell circuit located at a distance from the apparatus.

Guns which are utilized to project a beam of light are commonly employed in connection with various types of target games. It is not considered that a detailed understanding of the present invention requires a detailed discussion of such prior guns. They have been constructed in a number of different ways. The manners in which they have been constructed are considered to be unsatisfactory in providing as intense a beam of light as reasonably possible from a light bulb.

Further, it is not considered that these prior apparatuses have been constructed so as to provide a simple, effective mechanical shutter action serving to pass a beam of light for a comparatively short interval. The latter is quite important in connection with photocell circuits used in targets that are sensitive to a rapid change in the level of illumination in order to provide for the actuation of a target mechanism. Such circuits are increasingly being considered to be desirable because they are not actuated by normal ambient illumination but instead are actuated by a change in illumination level.

SUMMARY OF THE INVENTION

An objective of the present invention is to provide new and improved apparatus for use in projecting a light beam from a common light bulb. A further related objective is to provide an apparatus to this type which is effective, simple, and easy to adjust. A still further objective of the present invention is to provide simulated guns for use in projecting a beam of light which are constructed so as to include a shutter mechanism so as to provide for a rapid change in light intensity. In connection with the latter objective related objectives are to provide apparatuses such as guns which are trigger operated, which are mechanically comparatively simple, and which are comparatively inexpensive to maintain and construct, which are capable of withstanding significant physical abuse, and which can be easily and conveniently utilized.

In accordance with this invention the broad objectives of this invention are achieved by providing an apparatus for projecting a light beam having an incandescent light bulb and a lens means for transmitting light emitted by the light bulb as a beam of light in which the improvement comprises: cooperating mounting means for mounting said bulb relative to said lens means, said mounting means comprising a base for said light bulb and bearing means mounted within the interior of said housing, said base and said bearing means having corresponding spherical surfaces frictionally engaging one another.

The more specific objective of the invention noted in the preceding are achieved by providing a simulated gun-type apparatus having a housing, a light bulb mounted within the interior thereof, a lens for transmitting a beam of light from said light bulb, a trigger mounted on said housing and switch means located on said housing so as to control the operation of said light bulb when said trigger is actuated in which the improvement comprises: a shutter pivotally mounted within said apparatus so as to normally block the transmission of light from said light bulb to said lens, said shutter being capable of being moved to an open position so as to permit light from said light bulb to reach said lens, spring means normally biasing said shutter in said closed position, an actuator slidably mounted within said housing, spring means for holding said actuator in an uncocked position, latch means for holding said actuator in a cocked position in which said spring means exerts a force on said actuator so as to tend to return said actuator to said uncocked position, cam means on said actuator for moving said shutter as said actuator is moved from said cocked to said uncocked position, cam follower means connected to said shutter for engaging said cam means as said actuator is moved from said cocked to said uncocked position.

BRIEF DESCRIPTION OF THE DRAWING

Because of the nature of this invention it is considered that this invention is best more fully described with reference to the accompanying drawing in which.

Figure 1:
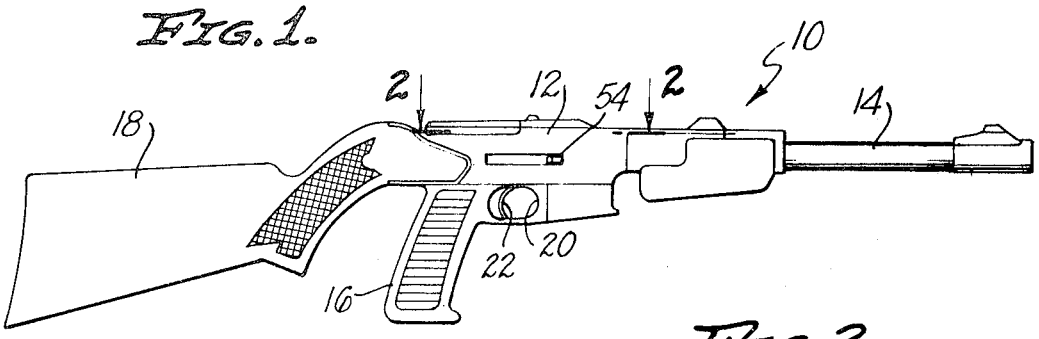
FIG. 1 is a side elevation view of a presently preferred apparatus in accordance with this invention constructed so as to simulate a type of gun.

The particular apparatus shown is constructed so as to include the operative concepts or principles of the invention set forth and defined in the appended claims. It is believed that it will be obvious that these same concepts or principles can be embodied within other somewhat differently appearing and differently constructed structures through the use or exercise of routine engineering skill.

DETAILED DESCRIPTION

In the drawing there is shown an apparatus 10 for projecting a beam of light which is shaped so as to simulate a gun. This apparatus 10 includes a housing 12 connecting a simulated barrel 14, a simulated handle 16 and a simulated gun stock 18. A portion of this housing 12 adjacent to the handle 16 is formed so as to simulate a trigger guard (not separately numbered) having a trigger access opening 20.

Figure 3:
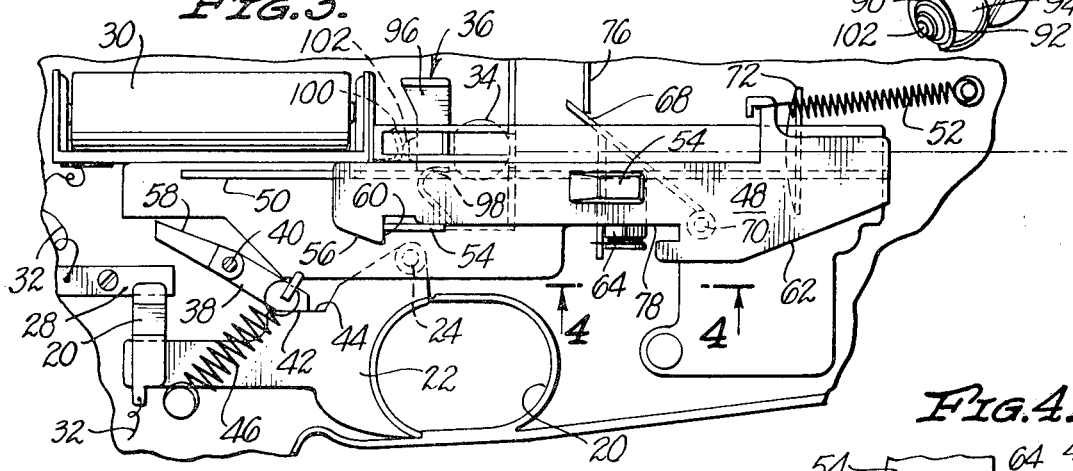
FIG. 3 is a partial cross-sectional view at the same scale as FIG. 2 taken at line 3—3 of FIG. 1.

An elongated trigger 22 is pivotally mounted within the housing 12 by means of a pivot pin 24 so as to be capable of being engaged so as to be rotated clockwise as viewed in FIG. 3. Such rotation of the trigger 22 accomplishes several actions within this apparatus 10. It moves a resilient contact arm 26 forming a part of a switch mechanism (not separately numbered) into engagement with a conductor 28 mounted within the interior of the housing 12. This serves to complete a circuit including batteries 30, wires 32 and an incandescent light bulb 34 mounted on a holder 36 so that this bulb 34 emits light. The construction of this holder 36 is considered important and is subsequently described in greater detail.

The actuation of the trigger 22 is also employed so as to cause rotation of a latch lever 38 mounted upon a pivot pin 40. Normally an end 42 of the lever 38 is biased against an actuating surface 44 on the trigger 22 by means of a small coil spring 46 so that as the trigger 22 is actuated this end 42 slides against the surface 44 in order to rotate the lever 38 counterclockwise as viewed in FIG. 3. Such rotation is important in connection with the operation of an actuator 48.

Figure 2:
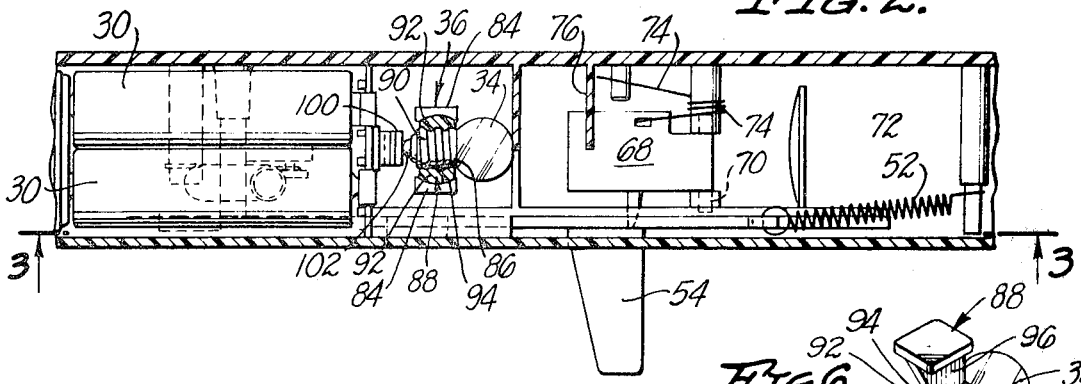
FIG. 2 is a partial cross-sectional view taken at line 2—2 of FIG. 1 at an enlarged scale.
Figure 6:
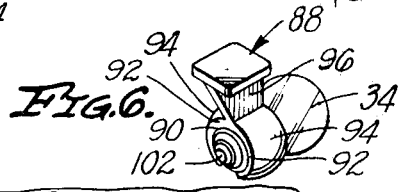
FIG. 6 is an isometric view of a bulb mounting structure employed with the illustrated apparatus.
Figure 5:
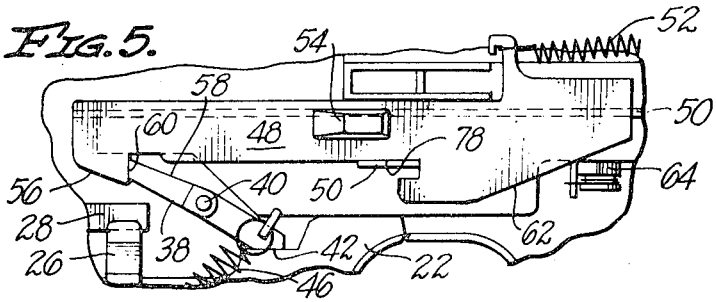
FIG. 5 is a partial cross-sectional view corresponding to FIG. 3 in which the actuator is located in a cocked position and in which various parts are shown as they are located when the actuator is in the cocked position.

This actuator 48 is mounted for linear movement within the housing 12 by means of guides 50. It is normally biased by means of a coil spring 52 toward an uncocked position as shown in FIGS. 2 and 3. Through the movement of a cocking arm 54 attached to this actuator 48 which extends to the exterior of the housing 12 the actuator 48 may be moved to a cocked position as shown in FIG. 5. During such movement a sloping surface 56 on the actuator 48 slides along an end 58 of the lever 38 until such time as the lever 38 is biased by the spring 46 into a notch 60 in the actuator 48. In this cocked position the lever 38 holds the actuator 48 against movement until the trigger 22 is actuated a indicated in the preceding in order to move or release the lever 38.

When this occurs the spring 52 will move the actuator 48 back to the uncocked position. During such movement a cam surface 62 on the actuator 48 will abut against a projecting lever 64. This lever 64 is rotatably mounted on a post 66 which extends downwardly from a gate-type shutter 68. This shutter 68 is pivotally mounted on a shaft 70 so as to extend across and close off the interior of the housing 12 between the light bulb 34 and a lens 72. The shutter 68 is normally biased by a spring 74 into this position so as to close off the interior of the housing 12 so that no light escapes from the bulb 34 except when the shutter 68 is deliberately moved. A small wall 76 in the interior of the housing 12 acts as a stop for this shutter 68 as it is biased to a normally closed position by means of the conventional spring.

By virtue of this construction as the actuator 48 is moved against the lever 64 the surface 62 will serve to pull the shutter 68 downwardly against the force exerted by the spring 74 so that light from the bulb 34 will reach the lens 72. A notch 78 is provided in the actuator 48 at the end of the surface 62 so that the after the shutter 68 has been moved downwardly to an open position during the movement of the actuator 48 the spring 78 will automatically swing the shutter 68 closed. With the described structure the shutter 68 is operated after the bulb 34 is turned on for a sufficient time so as to provide the maximum level of illumination possible with the bulb 34.

Figure 4:
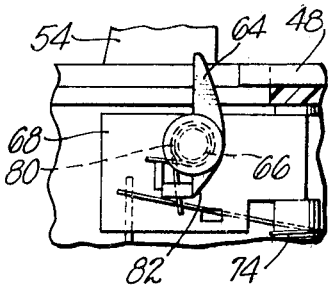
FIG. 4 is a partial cross-sectional view taken at line 4—4 of FIG. 3.

In order to prevent the lever 64 from interfering with the movement of the actuator 48 to the cocked position this lever 64 is preferably biased by means of a spring 80 as indicated in FIG. 4 of the drawing. This spring 80 biases the lever 64 so that it will normally hit against a small internal wall 82 in such a manner that it can temporarily deflect during the movement of the actuator 48 toward the cocked position so as to accommodate such movement.

Prior to the apparatus 10 being used it is considered desirable to manipulate the bulb 34 relative to the holder 36 so that the filament (not separately shown) of the bulb is oriented with respect to the lens 72 so as to obtain a light beam when the shutter 68 is open which is projected by this lens 72 which is as intent and coherent as reasonably possible. In accordance with this invention this is achieved by constructing the holder 36 so that it includes two spaced, upwardly extending, electrically non-conductive, resilient arms 84 each of which carries an internal spherically shaped holding or bearing surface 86.

This holder 36 also includes a bifurcated, electrically non-conductive, resilient base 88 for use in holding the base 90 of the bulb 34. This base 88 has bifurcations or arms 92 which are shaped so as to closely fit around the exterior of the base 90 in order to hold the bulb 34. These arms 92 have external surfaces 94 which are shaped as portions of spheres so as to correspond to the curvatures of the bearing surfaces 86. These surfaces 94 are resiliently engaged by the bearing surfaces 86 so that the bulb 34 is frictionally held by the complete holder 36 in such a manner that its position may be adjusted as reasonably desired relative to the lens 72.

In order to facilitate mounting of the bulb 34 with respect to the arms 84 the base 88 preferably includes a small handle 96 which can be used in mounting and manipulating this bulb 34. The holder 36 also includes resilient conductors 98 and 100 which are connected by wires 32 for the obvious purpose. The conductor 98 resiliently engages the base 90 of the bulb 34 while the conductor 100 engages a contact 102 on the base 90 of the bulb 34.

I claim:

1. In a simulated gun apparatus for projecting a light beam, said apparatus including a housing, a trigger movably mounted on said housing, a circuit including a light bulb and a switch for controlling the operation of said light bulb located within said housing, and a shutter movable between open and closed positions for blocking and permitting the transmission of light from said light bulb the improvement which comprises:

an actuator having ends, said actuator being slidably mounted within said housing so as to be capable of being moved between an uncocked position and a cocked position, said actuator including a cocking arm accessible from the exterior of said housing for use in moving said actuator from said uncocked position to said cocked position, said actuator including a sloping surface adjacent to one end thereof and a notch positioned adjacent to said sloping surface, said actuator also including a cam surface adjacent to the other end thereof and a notch adjacent to said cam surface, said notches being located adjacent of the extremities of said surfaces remote from said ends, spring means connecting said actuator and said housing for biasing said actuator in said uncocked position, a trigger pivotally mounted within said housing, a portion of said trigger being accessible from the exterior of said housing, said trigger including an actuating surface, a latch lever pivotally mounted intermediate its ends within said housing, one of said ends of said latch lever being adjacent to said actuating surface and the other of said ends of said latch lever being adjacent to said first mentioned end of said actuator, spring means connecting said latch lever and said housing for biasing said latch lever so that said first mentioned end of said latch lever bears against said actuating surface, said second mentioned end of said latch lever being capable of being engaged by said sloping surface on said actuator as said actuator is moved from said uncocked to said cocked position so as to cause rotation of said latch lever such as will permit said latch lever to engage said notch adjacent to said sloping surface so as to hold said actuator in said cocked position, said trigger being capable of being pivoted so as to pivot said actuating lever in order to move said second mentioned end of said latch lever from engaging with said notch adjacent to said sloping surface so as to permit said spring means connecting said actuator and said housing to move said actuator to said uncocked position, said shutter being pivotally mounted within said housing, spring means connecting said shutter and said housing for biasing said shutter in said closed position, lever means connected to said shutter for causing movement of said shutter between said open and closed positions, said lever means being positioned so as to be engaged by said cam surface as said actuator is moved from said cocked position to said uncocked position so as to move said shutter to said open position, said lever means being capable of being disengaged from said cam surface when said actuator is moved into said uncocked position so as to move into said second mentioned notch, said second mentioned spring means serving to cause movement of said shutter to said closed position and said lever means into said second mentioned notch as said actuator is moved into said uncocked position.

2. A simulated gun apparatus as claimed in claim 1 wherein:

said lever means is pivotally mounted on said shutter, and including spring means biasing said lever means relative to said shutter so as to position said lever means so that it will be engaged by said cam surface as said actuator is moved toward said uncocked position, said spring means biasing said lever means permitting movement of said lever means upon engagement with said actuator so as to permit said actuator to be moved from said uncocked to said cocked position.

3. A simulated gun apparatus as claimed in claim 1 wherein:

said switch includes a conductor mounted within the interior of said housing and a resilient contact arm mounted on said trigger, said contact arm being located so as to be moved into contact with said conductor upon said trigger being pivoted so as to cause movement of said latch lever out of said notch adjacent to said sloping surface.

4. A simulated gun apparatus as claimed in claim 1 wherein:

said lever means is pivotally mounted on said shutter, and including, spring means biasing said lever means relative to said shutter so as to position said lever means so that it will be engaged by said cam surface as said actuator is moved toward said uncocked position, said spring means biasing said lever means permitting movement of said lever means upon engagement with said actuator so as to permit said actuator to be moved from said uncocked to said cocked position, and wherein, said switch includes a conductor mounted within the interior of said housing and a resilient contact arm mounted on said trigger, said contact arm being located so as to be moved into contact with said conductor upon said trigger being pivoted so as to cause movement of said latch lever out of said notch adjacent to said sloping surface.

* * * * *